US009957765B2

(12) United States Patent
Schultz et al.

(10) Patent No.: US 9,957,765 B2
(45) Date of Patent: May 1, 2018

(54) DOWNHOLE VIBRATORY BYPASS TOOL

(71) Applicant: Thru Tubing Solutions, Inc., Oklahoma City, OK (US)

(72) Inventors: Roger Schultz, Newcastle, OK (US); Andy Ferguson, Moore, OK (US)

(73) Assignee: Thru Tubing Solutions, Inc., Oklahoma City, OK (US)

( * ) Notice: Subject to any disclaimer, the term of this patent is extended or adjusted under 35 U.S.C. 154(b) by 231 days.

(21) Appl. No.: 15/024,696

(22) PCT Filed: Jun. 11, 2015

(86) PCT No.: PCT/US2015/035381
§ 371 (c)(1),
(2) Date: Mar. 24, 2016

(87) PCT Pub. No.: WO2015/191889
PCT Pub. Date: Dec. 17, 2015

(65) Prior Publication Data

US 2016/0230487 A1 Aug. 11, 2016

Related U.S. Application Data

(60) Provisional application No. 62/010,546, filed on Jun. 11, 2014.

(51) Int. Cl.
*E21B 28/00* (2006.01)
*E21B 7/24* (2006.01)
(Continued)

(52) U.S. Cl.
CPC ..... *E21B 28/00* (2013.01); *E21B 7/24* (2013.01); *E21B 31/005* (2013.01); *E21B 43/08* (2013.01)

(58) Field of Classification Search
CPC ..... E21B 28/00; E21B 31/005
See application file for complete search history.

(56) References Cited

U.S. PATENT DOCUMENTS 3,422,894 A * 1/1969 Brandon ..... E21B 43/003 166/177.2
3,464,120 A * 9/1969 Alder ..... E21B 7/04 175/45

(Continued)

OTHER PUBLICATIONS

PCT/US2015/035381; International Search Report and Written Opinion; dated Sep. 23, 2015; 14 pages.

*Primary Examiner* — Shane Bomar
(74) *Attorney, Agent, or Firm* — Hall Estill Law Firm; Bryan A. Fuller

(57) ABSTRACT

A downhole tool is disclosed herein that has an inlet for receiving fluid into a housing of the downhole tool. The downhole tool further includes a vibratory apparatus at least partially disposed within the housing of the downhole tool, the vibratory apparatus having an operational flow path disposed therein to operate the vibratory apparatus when fluid flowing through the operational flow path is above a predetermined pressure. Furthermore, the downhole tool has a bypass passageway disposed in the housing for providing an additional flow path for fluid through the downhole tool to prevent fluid from reaching the predetermined pressure in the operational flow path of the vibratory apparatus, the bypass passageway selectively blockable such that fluid in the operational flow path is increased above the predetermined pressure to activate the vibratory apparatus when the bypass passageway is blocked. A method of using the downhole tool is also disclosed.

17 Claims, 4 Drawing Sheets

(51) Int. Cl.
*E21B 31/00* (2006.01)
*E21B 43/08* (2006.01)

(56) References Cited

U.S. PATENT DOCUMENTS

| | | | | |
|---|---|---|---|---|
| 9,366,100 | B1 * | 6/2016 | Baudoin | E21B 28/00 |
| 2009/0223676 | A1 | 9/2009 | Eddison et al. | |
| 2010/0193187 | A1 | 8/2010 | Briquet et al. | |
| 2011/0203809 | A1 | 8/2011 | Knobloch, Jr. et al. | |
| 2012/0031615 | A1 | 2/2012 | Connell et al. | |
| 2012/0193145 | A1 | 8/2012 | Anderson | |

* cited by examiner

DOWNHOLE VIBRATORY BYPASS TOOL

CROSS-REFERENCE TO RELATED APPLICATIONS

The present application is a national stage application of a PCT application having International Application No. PCT/US2015/035381, filed Jun. 11, 2015, which claims priority to U.S. Provisional Application having U.S. Ser. No. 62/010,546, filed Jun. 11, 2014, which claims the benefit under 35 U.S.C. 119(e). The disclosure of which is hereby expressly incorporated herein by reference.

BACKGROUND OF THE DISCLOSURE

Field of the Invention

The present disclosure relates to a downhole tool that permits fluid to selectively bypass a vibratory tool.

Description of the Related Art

Vibratory tools can be used in bottom hole assemblies (BHAs) along with other tools that can use abrasive fluids, such as an abrasive perforator. Flowing an abrasive fluid through a vibratory tool would, at the very least, significantly reduce the life of the vibratory tool. Additionally, pressure drop at a perforator can be reduced due to the pressure drop across a vibratory tool.

Accordingly, there is a need for a downhole tool that will permit the abrasive fluid to bypass the vibratory tool until it is desired for the vibratory tool to be used.

SUMMARY OF THE DISCLOSURE

This disclosure is directed toward a downhole tool that includes an inlet for receiving fluid into a housing of the downhole tool. The downhole tool further includes a vibratory apparatus at least partially disposed within the housing of the downhole tool, the vibratory apparatus having an operational flow path disposed therein to operate the vibratory apparatus when fluid flowing through the operational flow path is above a predetermined pressure. Furthermore, the downhole tool has a bypass passageway disposed in the housing for providing an additional flow path for fluid through the downhole tool to prevent fluid from reaching the predetermined pressure in the operational flow path of the vibratory apparatus, the bypass passageway selectively blockable such that fluid in the operational flow path is increased above the predetermined pressure to activate the vibratory apparatus when the bypass passageway is blocked.

This disclosure is also directed toward a method of using the downhole tool described herein. The method includes the step of running a bottom hole assembly into a wellbore. Fluid is then flowed into the bottom hole assembly to perform oil and gas operations. A vibratory operation can then be initiated in the wellbore. The method can then include the step of stopping the vibratory operation in the wellbore. Once the vibratory operation is stopped, a oil and gas operations are continued.

DETAILED DESCRIPTION OF THE DISCLOSURE

Figure 1:
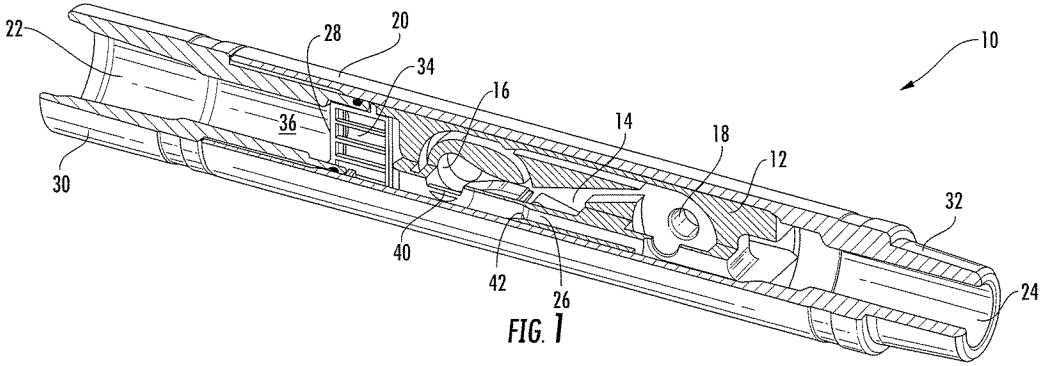
FIG. 1 is a perspective view of a downhole tool with a quarter section removed and constructed in accordance with the present disclosure.
Figure 2:
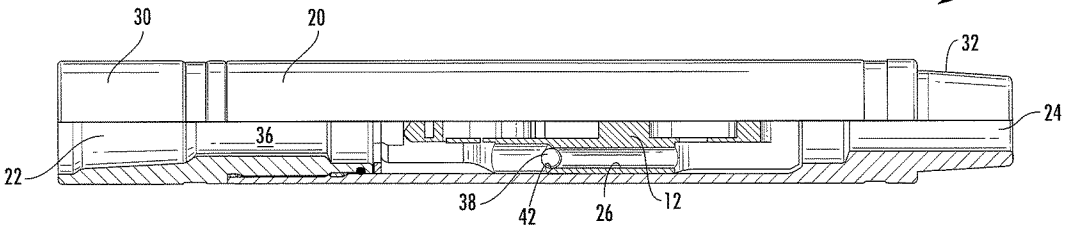
FIG. 2 is a half cross-sectional view and half side elevation view of the downhole tool constructed in accordance with the present disclosure.
Figure 3:
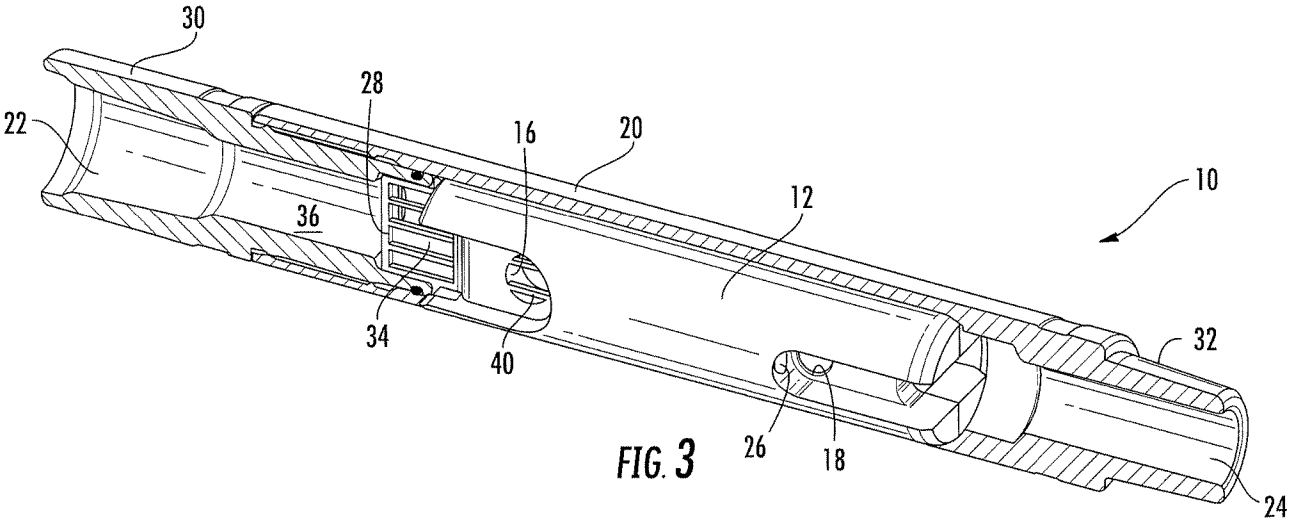
FIG. 3 is a partial cross-sectional view and perspective of the downhole tool constructed in accordance with the present disclosure.
Figure 4:
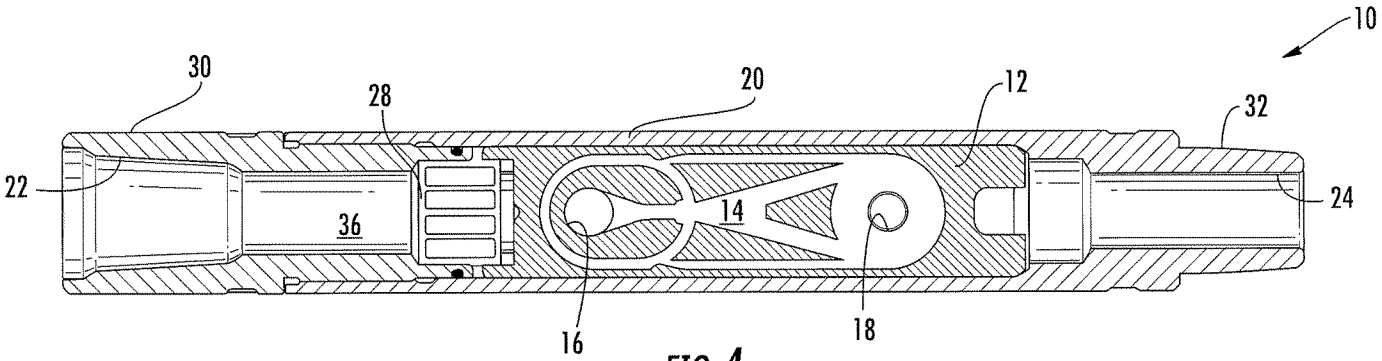
FIG. 4 is a cross-sectional view of the downhole tool constructed in accordance with the present disclosure.
Figure 5:
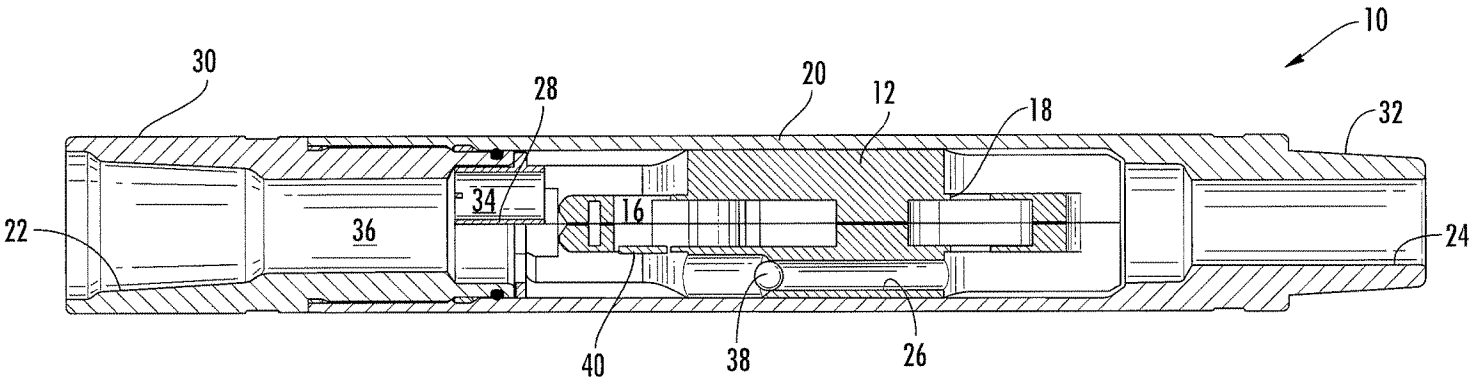
FIG. 5 is a cross-sectional view of the downhole tool turned 90° from the cross-sectional view shown in FIG. 4.

The present disclosure relates to a bypass tool 10 for running down into a well as part of a bottom hole assembly (BHA). The bypass tool 10 is used to divert the flow of fluid to a vibratory tool 12, which is selectively in fluid communication with the bypass tool 10. The vibratory tool 12 can be any tool known in the art for providing vibration and/or agitation to a BHA to advance the BHA in the well, such as the Thru Tubing Solutions, Inc.'s XRV, National Oilwell Varco's Agitator and Oil State's Tempress tool.

The fluid can flow around or through a portion of the vibratory tool 12 and then be diverted to the vibratory tool 12 to operate the vibratory tool 12. The vibratory tool 12 can be disposed within the bypass tool 10, partially within the bypass tool 10 or positioned adjacent to the bypass tool 10 on the downhole side of the bypass tool 10. Generally, the vibratory tool 12 can include an, operational flow path 14 having an inlet 16 and an outlet 18. When fluid is permitted to flow into the operational flow path 14, the vibratory tool 12 operates as intended. It should be understood and appreciated that the vibratory tool 12 does not have to be a completely separate tool. For example, the bypass tool 10 may include components that cause the bypass tool 10 to vibrate.

Referring now to FIGS. 1-5, the bypass tool 10 includes a housing 20, an inlet 22 for allowing fluid to flow into the bypass tool 10, an outlet 24 for allowing fluid to flow out of the bypass tool 10, a bypass passageway 26 disposed between the inlet 22 and outlet 24 for providing an alternate flow path for fluid passing through the bypass tool 10, and a screen 28 (or grate) to divert the flow of objects from the operational flow path 14 of the vibratory tool 12. The bypass tool 10 also includes a top adapter 30 for connecting the bypass tool 10 to a tool disposed above the bypass tool 10 in the BHA and a bottom adapter 32 for connecting the bypass tool 10 to other tools included in the BHA.

The screen 28 is disposed downstream of the inlet 22 of the bypass tool 10 and upstream of the vibratory tool 12 to block the flow of objects to the operational flow path 14 of the vibratory tool 12 and permit the flow of fluid to flow into the operational flow path 14 of the vibratory tool 12 and the bypass passageway 26. The screen 28 can be sized and shaped in any manner such that it prevents the flow of certain sized objects from entering an annulus area 34 disposed adjacent to the inlet 16 of the operational flow path 14 of the vibratory tool 12. In one embodiment, the screen 28 is a half cylinder shape to block the flow of objects for half of an internal portion 36 of the bypass tool 10 upstream of the vibratory tool 12. The screen 28 also acts to direct a fluid blocking member 38 toward the bypass passageway 26 disposed in the bypass tool 10.

In another embodiment of the present disclosure, a second screen 40 can be provided such that the second screen 40 is disposed at the inlet 16 of the vibratory tool 12. The second screen 40 prevents the fluid blocking member 38 from entering the operational flow path 14 of the vibratory tool 12 and forces the fluid blocking member 38 into the bypass passageway 26 wherein the fluid blocking member 38 will engage a seat 42 (or shoulder) disposed in the bypass passageway 26 to prevent the flow of fluid through the bypass passageway 26. When fluid is blocked from flowing through the bypass passageway 26, the fluid is forced to flow exclusively through the operational flow path 14 of the vibratory tool 12 activating the vibratory tool 12 and causing it to vibrate/agitate.

In use, fluid is flowed into the inlet 22 of the bypass tool 10 and permitted to flow through the operational flow path 14 of the vibratory tool 12 and the bypass passageway 26. When fluid is permitted to flow through the operational flow path 14 and the bypass passageway 26, the vibratory tool 12 is not generating a pressure drop, thus there is no vibration or agitation occurring. When vibration characteristics are desired, the fluid blocking member 38 is pumped down into the bypass tool 10. Due to the first and second screens 28 and 40, the fluid blocking member 38 is directed toward the bypass passageway 26 where the fluid blocking member 38 ultimately ends up contacting the seat 42 disposed in the bypass passageway 26 to block the flow of fluid through the bypass passageway 26. Once fluid is blocked from flowing through the bypass passageway 26, all fluid is directed toward the operational flow path 14 of the vibratory tool 12 which causes the vibratory tool 12 to vibrate.

Figure 6:
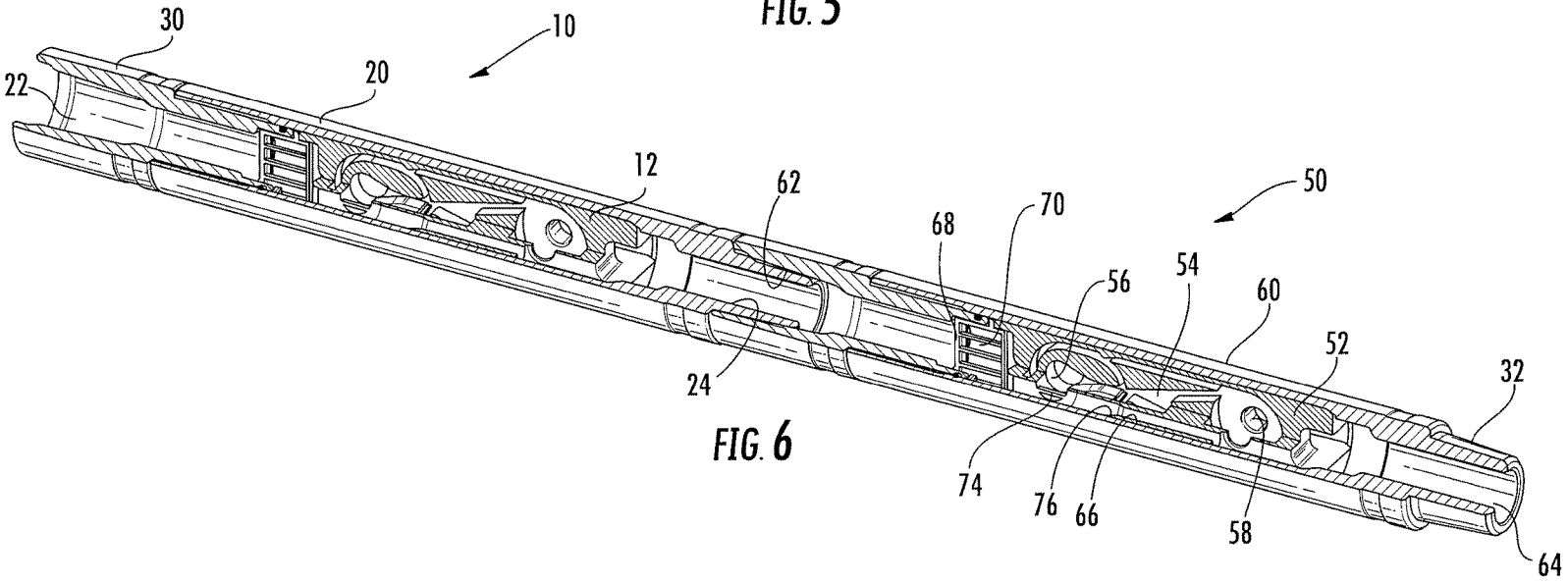
FIG. 6 is a perspective view of another embodiment of a downhole tool with a quarter section removed and constructed in accordance with the present disclosure.
Figure 7:
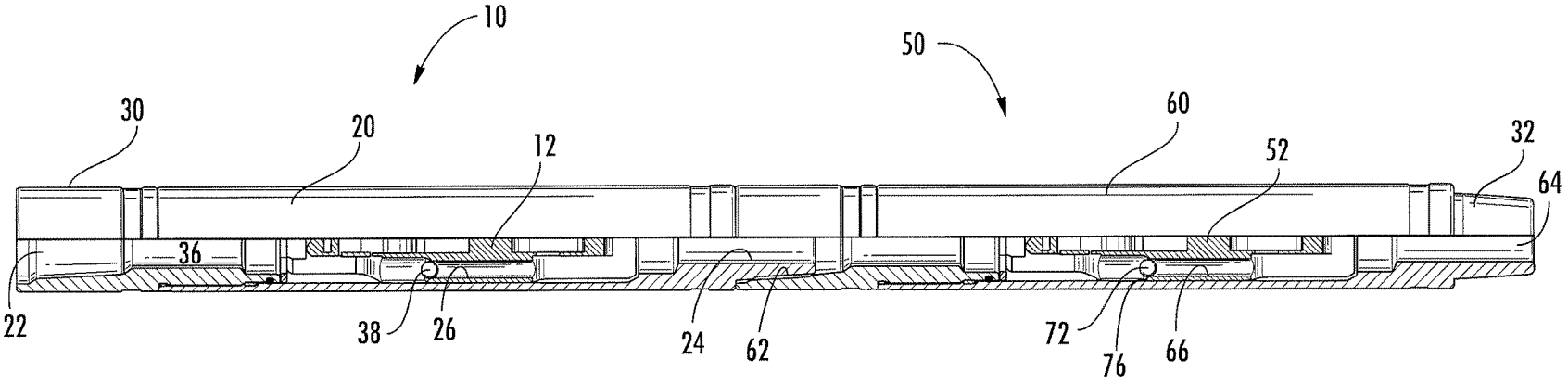
FIG. 7 is a half cross-sectional view and half side elevation view of the downhole tool shown in FIG. 6 and constructed in accordance with the present disclosure.

In yet another embodiment of the present disclosure, shown in FIGS. 6-7, the bottom hole assembly can include a second bypass tool 50 to divert the flow of fluid to a second vibratory tool 52, which is selectively in fluid communication with the second bypass tool 50. The second vibratory tool 52 can be substantially the same as the first vibratory tool 12. The fluid can flow around or through a portion of the second vibratory tool 50 and then be diverted to the second vibratory tool 52 to operate the second vibratory tool 52. The second vibratory tool 52 can be disposed within the second bypass tool 50, partially within the second bypass tool 50 or positioned adjacent to the second bypass tool 52 on the downhole side of the second bypass tool 50. Generally, the second vibratory tool 52 can include an operational flow path 54 having an inlet 56 and an outlet 58. When fluid is permitted to flow into the operational flow path 54 of the second vibratory tool 52, the second vibratory tool 52 operates as intended. Similar to the first vibratory tool 12, the second vibratory tool 52 does not have to be a completely separate tool. For example, the second bypass tool 52 may include components that cause the second bypass tool 52 to vibrate.

Similar to the first bypass tool 10, the second bypass tool 50 includes a housing 60, an inlet 62 for allowing fluid to flow into the second bypass tool 50, an outlet 64 for allowing fluid to flow out of the second bypass tool 50, a bypass passageway 66 disposed between the inlet 62 and the outlet 64 of the second bypass tool 52 for providing an alternate flow path for fluid passing through the second bypass tool 52, and a screen 68 (or grate) to divert the flow of objects from the operational flow path 54 of the second vibratory tool 52.

The screen 68 is disposed downstream of the inlet 62 of the second bypass tool 50 and upstream of the second vibratory tool 52 to block the flow of objects to the operational flow path 54 of the second vibratory tool 52 and permit the flow of fluid to flow to the operational flow path 54 of the second vibratory tool 52 and the bypass passageway 66 of the second bypass tool 50. The screen 68 can be sized and shaped in any manner such that it prevents the flow of certain sized objects from entering an annulus area 70 disposed adjacent to the inlet 56 of the operational flow path 54 of the second vibratory tool 52. In one embodiment, the screen 68 is a half cylinder shape to block the flow of objects for half of the internal portion of the second bypass tool 50 upstream of the second vibratory tool 52. The screen 68 also acts to direct a second fluid blocking member 72 toward the bypass passageway 66 in the second bypass tool 50.

In another embodiment of the present disclosure, a second screen 74 can be provided in the second bypass tool 50 such that the second screen 74 is disposed at or near the inlet 56 of the second vibratory tool 52. The second screen 74 of the second bypass tool 50 prevents the second fluid blocking member 72 from entering the operational flow path 54 of the second vibratory tool 52 and forces the second fluid blocking member 72 into the bypass passageway 66 of the second bypass tool 50 wherein the second fluid blocking member 72 will engage a seat 76 (or shoulder) disposed in the bypass passageway 66 of the second bypass tool 50 to prevent the flow of fluid through the bypass passageway 66. When fluid is blocked from flowing through the bypass passageway 66 of the second bypass tool 50, the fluid is forced to flow exclusively through the operational flow path 54 of the second vibratory tool 52 activating the second vibratory tool 52, which would vibrate and/or agitate the BHA.

It should be understood that the second fluid blocking member 72 is smaller than the first fluid blocking member 38, which allows the second fluid blocking member 72 to flow through the bypass passageway 26 disposed in the first bypass tool 10 and enter the second bypass tool 50 and ultimately engage the seat 76 disposed in the bypass passageway 66 of the second bypass tool 50. While not shown, it should be understood and appreciated that there can be additional bypass tools and vibratory tools implemented. For example, in the case of three bypass tools, there would be a third fluid blocking member that was smaller than the first and second fluid blocking members 38 and 72. This would permit the third fluid blocking member to pass through the bypass passageways 26 and 66 of the first and second bypass tools 10 and 50 and engage a seat disposed in a bypass passageway disposed in the third bypass tool.

In use, fluid is flowed into the inlet 22 of the first bypass tool 10 and permitted to flow through the operational flow path 14 of the first vibratory tool 12 and the bypass passageway 26 disposed in the first bypass tool 10. The fluid is then permitted to flow from the outlet 24 of the first bypass tool 10, into the inlet 62 of the second bypass tool 50 and through the operational flow path 54 of the second vibratory tool 52 and the bypass passageway 66 of the second bypass tool 50. When fluid is permitted to flow through the operational flow paths 14 and 54 of the first and second vibratory tools 12 and 52 and the bypass passageways 26 and 66 of the first and second bypass tools 10 and 50, the first and second vibratory tools 12 and 52 are not generating a pressure drop, thus there is no vibration occurring at either vibratory tool 12 or 52.

When vibration characteristics are desired, the second fluid blocking member 72 is pumped down into and through the first bypass tool 10 (forced into and through the bypass passageway 26 of the first bypass tool 10 via the first and second screens 28 and 40 of the first bypass tool 10) and into the second bypass tool 50. Due to the first and second screens 68 and 74 of the second bypass tool 50, the second fluid blocking member 72 is directed toward the bypass passageway 66 of the second bypass tool 50 where the second fluid blocking member 72 ultimately ends up contacting the seat 76 disposed in the bypass passageway 66 of the second bypass tool 50 to block the flow of fluid through the bypass passageway 66 of the second bypass tool 50. Once fluid is blocked from flowing through the bypass passageway 66 of the second bypass tool 50, all fluid is directed toward the operational flow path 54 of the second vibratory tool 52 which causes the second vibratory tool 52 to vibrate.

A situation may be encountered where vibration of the first vibratory tool 12 is desired in addition to the vibration of the second vibratory tool 52, or after vibration of the first vibratory tool 12 has ceased. In this situation, the first fluid blocking member 38 is pumped down into the first bypass tool 10. Due to the first and second screens 28 and 40 of the first bypass tool 10, the first fluid blocking member 38 is directed toward the bypass passageway 26 of the first bypass tool 10 where the first fluid blocking member 38 ultimately ends up contacting the seat 42 disposed in the bypass passageway 26 of the first bypass tool 10 to block the flow of fluid through the bypass passageway 26 of the first bypass tool 10. Once fluid is blocked from flowing through the bypass passageway 26 of the first bypass tool 10, all fluid is directed toward the operational flow path 14 of the first vibratory tool 12, which causes the first vibratory tool 12 to vibrate.

The present disclosure is also directed to a method of using the downhole bypass tool. The BHA can be run down into a wellbore. Fluid can be flowed into and through the BHA to perform a variety of downhole oil and gas operations. A vibratory operation can then be initiated in the wellbore. The vibratory operation can be stopped and the oil and gas operations can then be continued. A second vibratory operation can be initiated in the wellbore. Similar to the first vibratory operation, the second vibratory operation can be stopped and the oil and gas operations can again be continued.

From the above description, it is clear that the present disclosure is well adapted to carry out the objectives and to attain the advantages mentioned herein as well as those inherent in the disclosure. While presently preferred embodiments have been described herein, it will be understood that numerous changes may be made which will readily suggest themselves to those skilled in the art and which are accomplished within the spirit of the disclosure and claims.

What is claimed is:

1. A downhole tool, the tool comprising:

an inlet for receiving fluid into a housing of the downhole tool;

a vibratory apparatus at least partially disposed within the housing of the downhole tool, the vibratory apparatus having an operational flow path disposed therein to operate the vibratory apparatus when fluid flowing through the operational flow path is above a predetermined pressure;

a bypass passageway disposed in the housing for providing an additional flow path for fluid through the downhole tool to prevent fluid from reaching the predetermined pressure in the operational flow path of the vibratory apparatus, the bypass passageway selectively blockable such that fluid in the operational flow path is increased above the predetermined pressure to activate the vibratory apparatus when the bypass passageway is blocked, the bypass passageway includes a seat for engagement with a fluid blocking member; and a first screen disposed in the housing uphole of the vibratory apparatus to direct the fluid blocking member toward the bypass passageway and permit fluid to flow to the vibratory apparatus.

2. The tool of claim 1 wherein the downhole tool further includes a second screen to prevent the fluid blocking apparatus from blocking fluid from entering the operational flow path of the vibratory apparatus.

3. The tool of claim 1 wherein the vibratory apparatus is disposed entirely in the housing of the downhole tool.

4. The tool of claim 2 wherein the second screen is disposed at an inlet of the operational flow path of the vibratory apparatus.

5. The tool of claim 2 further comprising:

a second vibratory apparatus at least partially disposed within the housing of the downhole tool and downhole from the vibratory apparatus, the second vibratory apparatus having an operational flow path disposed therein to operate the second vibratory apparatus when fluid flowing through the operational flow path is above a predetermined pressure; and a second bypass passageway disposed in the housing for providing an additional flow path for fluid through a portion of the downhole tool to prevent fluid from reaching the predetermined pressure in the operational flow path of the second vibratory apparatus, the second bypass passageway selectively blockable such that fluid in the operational flow path of the second vibratory tool is increased above the predetermined pressure to activate the second vibratory apparatus when the second bypass passageway is blocked.

6. The tool of claim 5 wherein the downhole tool includes a third screen disposed in the housing uphole of the second vibratory apparatus to direct a second fluid blocking member toward the second bypass passageway and permit fluid to flow to the second vibratory apparatus.

7. The tool of claim 6 wherein the downhole tool further includes a fourth screen disposed at an inlet of the operational flow path of the second vibratory apparatus to prevent the second fluid blocking apparatus from blocking fluid from entering the operational flow path of the second vibratory apparatus.

8. The tool of claim 5 wherein the second bypass passageway includes a seat for engagement with a fluid blocking member.

9. A method, the method comprising the steps of:

running a bottom hole assembly into a wellbore, the bottom hole assembly includes a downhole tool, the downhole tool comprising:

an inlet for receiving fluid into a housing of the downhole tool;

a vibratory apparatus at least partially disposed within the housing of the downhole tool, the vibratory apparatus having an operational flow path disposed therein to operate the vibratory apparatus when fluid flowing through the operational flow path is above a predetermined pressure; and a bypass passageway disposed in the housing for providing an additional flow path for fluid through the downhole tool to prevent fluid from reaching the predetermined pressure in the operational flow path of the vibratory apparatus, the bypass passageway selectively blockable such that fluid in the operational flow path is increased above the predetermined pressure to activate the vibratory apparatus when the bypass passageway is blocked, the bypass passageway includes a seat for engagement with a fluid blocking member; and a first screen disposed in the housing uphole of the vibratory apparatus to direct the fluid blocking member toward the bypass passageway and permit fluid to flow to the vibratory apparatus;

flowing fluid into the bottom hole assembly to perform oil and gas operations;

initiating a vibratory operation in the wellbore;

stopping the vibratory operation in the wellbore; and continuing to perform oil and gas operations.

10. The method of claim 9 further comprising the steps of:

initiating a second vibratory operation in the wellbore;

stopping the second vibratory operation in the wellbore; and continuing to perform oil and gas operations.

11. The method of claim 9 wherein the downhole tool further includes a second screen to prevent the fluid blocking apparatus from blocking fluid from entering the operational flow path of the vibratory apparatus.

12. The method of claim 9 wherein the vibratory apparatus is disposed entirely in the housing of the downhole tool.

13. The method of claim 11 wherein the second screen is disposed at an inlet of the operational flow path of the vibratory apparatus.

14. The method of claim 11 further comprising:

a second vibratory apparatus at least partially disposed within the housing of the downhole tool and downhole from the vibratory apparatus, the second vibratory apparatus having an operational flow path disposed therein to operate the second vibratory apparatus when fluid flowing through the operational flow path is above a predetermined pressure; and a second bypass passageway disposed in the housing for providing an additional flow path for fluid through a portion of the downhole tool to prevent fluid from reaching the predetermined pressure in the operational flow path of the second vibratory apparatus, the second bypass passageway selectively blockable such that fluid in the operational flow path of the second vibratory tool is increased above the predetermined pressure to activate the second vibratory apparatus when the second bypass passageway is blocked.

15. The method of claim 14 wherein the downhole tool includes a third screen disposed in the housing uphole of the second vibratory apparatus to direct a second fluid blocking member toward the second bypass passageway and permit fluid to flow to the second vibratory apparatus.

16. The method of claim 15 wherein the downhole tool further includes a fourth screen disposed at an inlet of the operational flow path of the second vibratory apparatus to prevent the second fluid blocking apparatus from blocking fluid from entering the operational flow path of the second vibratory apparatus.

17. The method of claim 14 wherein the second bypass passageway includes a seat for engagement with a fluid blocking member.

* * * * *